US006427263B1

(12) United States Patent
Lindell

(10) Patent No.: US 6,427,263 B1
(45) **Date of Patent: *Aug. 6, 2002**

(54) DEVICE FOR MOVING PATIENTS

(76) Inventor: Tom Lindell, Mariehamnsgatan 22, S-164 79 Kista (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/664,058

(22) Filed: Sep. 18, 2000

Related U.S. Application Data

(63) Continuation-in-part of application No. 09/254,370, filed as application No. PCT/SE97/00852 on May 23, 1997, now Pat. No. 6,131,215.

(30) Foreign Application Priority Data

Aug. 29, 1996 (SE) ..... 96009576

(51) Int. Cl.[7] ..... A61G 7/10; A61G 1/02
(52) U.S. Cl. ..... 5/86.1; 5/607; 5/608; 5/610
(58) Field of Search ..... 5/86.1, 83.1, 607, 5/608, 611, 81.1 R, 81.1 MS

(56) References Cited

U.S. PATENT DOCUMENTS

| | | | | | |
|---|---|---|---|---|---|
| 2,984,843 | A | * | 5/1961 | Johnson | 5/86.1 |
| 3,284,816 | A | | 11/1966 | Laubsch | |
| 3,304,116 | A | * | 2/1967 | Stryker | 5/86.1 |
| 3,814,414 | A | * | 6/1974 | Chapa | 5/607 |
| 4,006,499 | A | * | 2/1977 | Young | 5/608 |
| 4,028,752 | A | | 6/1977 | Oerthel | 5/81.1 R |
| 4,939,801 | A | * | 7/1990 | Schaal et al. | 5/607 |
| 4,958,817 | A | * | 9/1990 | Heller et al | 5/608 |
| 5,121,514 | A | | 6/1992 | Rosane | 5/628 |
| 5,329,655 | A | | 7/1994 | Garner | 5/81.1 R |

FOREIGN PATENT DOCUMENTS

| | | |
|---|---|---|
| DE | 3619837 | 12/1987 |
| GB | 2294883 | 5/1966 |

* cited by examiner

*Primary Examiner*—Alexander Grosz
(74) *Attorney, Agent, or Firm*—Young & Thompson

(57) ABSTRACT

A roll coach for moving patients to and from a hospital bed is disclosed. It comprises a frame, a movable bunk mounted on said frame, a lifting mechanism connecting the bunk with the frame and operative to move the bunk in a vertical direction, and a tilting mechanism operative to tilt the bunk such as to bring the side of the bunk in contact with the bed surface.

17 Claims, 6 Drawing Sheets

DEVICE FOR MOVING PATIENTS

This is a continuation-in-part of U.S. Ser. No. 09/254,370 now U.S. Pat. No. 6,131,215, which is the National Stage on PCT/SE97/00852, filed May 23 1997.

The present invention relates in general to methods and devices for moving non-ambulatory patients to and from hospital beds.

In particular it relates to a roll coach having a tiltable bunk for safe transfer of a patient from a bed to said bunk and back again, after the patient having been subjected to various treatments, such as surgery, therapy, hygienic care, toilet etc.

BACKGROUND OF THE INVENTION

For the purposes of the present application the term "bunk" means a resting surface that is not a proper bed, but which is suitable for temporary placement of a patient for transport or treatment purposes.

In the medical care of non-ambulatory patients, the process of moving a patient from a bed and to another means for transport, basically involves the use of two different methods: moving by lifting, or moving by dragging the patient off the bed.

For lifting purposes it is required to install electrical lifting means, commonly mounted in the ceiling, or a portable lifting carriage, and a lifting or hoisting sling. This method would often require two medical staff, and it can be very trying for both the staff and for the patient, especially if the patient only may be moved in a horizontal position, such as when there is a spinal injury or other internal damage requiring careful handling of the patient.

When the patient is to be dragged off the bed and onto a temporary bunk or roll coach, the patient must be moved from the center of the bed to the edge of the bed before the transfer to the bunk may be made. often there is present a small gap or space between the mattress of the bed and the roll coach. This gap may cause problems in the transfer from bed to bunk.

Frequently it is required to move the patient from the bed to a wheel-chair. This requires that the patient be moved to the side of the bed, the legs must be brought over the edge, and the patient must be raised to a sitting position. Thereafter a sideways movement must take place, possibly by use of a special gliding plate, temporarily provided between the bed and the wheel-chair.

In order to facilitate the sideways movement to the edge of the bed, there has recently been introduced glide mats, which consist of a sheet of fabric having two opposite edges attached to each other so as to form a tube like configuration having a low friction interior surface. The tubelike glide mat is placed slightly underneath the patient in a flat configuration, and when the patient is dragged carefully to the side, the upper side of the glide mat will form a sheet gliding on the lower portion, by virtue of its low friction interior surface.

When the patient is to be replaced in the bed from the bunk after having beet treated, it may be very difficult and sometimes impossible to push the patient back onto the bed. The gap mentioned above may cause problems and discomfort also in this case. Finally, the patient will end up on the edge of this bed after having been transferred from the bunk, and must be pushed further towards the middle of the bed, in order to take a comfortable position in the bed. Of course the use of a glide mat will facilitate also the placing of the patient onto the bed.

A requirement in the care of non-ambulatory patients is that they must be allowed to stand up at least once a day during 15–20 minutes. Unless this therapy is carried out, the patient will suffer complications in terms of i.a. decalcification of the skeleton, heart insufficiency, muscle atrophy, problems with the peristalsis, and balance problems.

Normally the procedure used today for the kind of therapy outlined above is to move the patient from the bed to a wheel-chair in order to transport the patient to the location in the hospital where therapy equipment is available.

The patient is then transferred from the wheel-chair onto a special tiltable bunk or coach, where the patient may be raised to an upright position, while still resting against the bunk.

After the therapy the patient must again be transferred to the wheel-chair, transported back to the ward, where he/she finally is transferred onto the bed. Thus, this simple therapy requires a substantial amount of work and inconvenience for the staff and patient.

In U.S. Pat. No. 4,028,752 there is disclosed an apparatus for lifting, arranging and/or transporting non-ambulatory patients. It includes a mobile support and an elongated element mounted thereon, to serve as a temporary bunk for a patient to be moved. The operation of the apparatus according to this patent is very similar to a fork-lift device. It provides three different movements, raising, lowering and tilting. By tilting the frame on which the bunk is mounted, the bunk is positioned alongside of a patient, who is then placed on the bunk.

In practical use of this kind of equipment a problem is that the bunk will not be inserted underneath the patient, instead the bunk pushes the patient sideways. Also, a dragging action is required in order to bring the patient onto the bunk.

In DE-36 19 837 there is disclosed a lifting device for non-ambulatory patients. It comprises a carrying frame with a conveyor belt system that is intended to engage on the patient's body, and to pull it onto the carrying frame. The frame is tiltable and may be raised or lowered. The device according to this disclosure is extremely complex, and therefore expensive to manufacture.

SUMMARY OF THE INVENTION

The present invention therefore sets out to provide a method and devices for easy and comfortable transfer of patients to and from hospital beds, without strain to medical staff or patients, wherein the drawbacks of the prior art devices are overcome. The bunk itself may be used for the necessary therapy, as outlined above, which can thus be performed in the ward.

The device according to the invention generally comprises a low frame provided with a lifting means to which a thin bunk is connected such that it may be tilted sideways around a horizontal axis, parallel to the bunk. The angular settings are made by means of linear actuators.

Thus, means are provided for bringing the patient lying on the bunk in and over the center of the bed, and thereafter the bunk is tilted slowly sideways towards the bed surface. The patient then slides down onto the bed, whereafter the bunk is pulled back. The patient is now located essentially in the center of the bed and need not be moved further. In particular, the lifting mechanism is mounted to the frame at a point on the longitudinal centerline of the frame. In this way easy access to beds may be had on both sides of the bunk, without having to turn the bunk 180°.

Further scope of applicability of the present invention will become apparent from the detailed description given hereinafter. However, it should be understood that the detailed description and specific examples, while indicating preferred embodiments of the invention, are given by way of illustration only.

The present invention will become more fully understood from the detailed description given hereinbelow.

DESCRIPTION OF PREFERRED EMBODIMENTS

Figure 1:
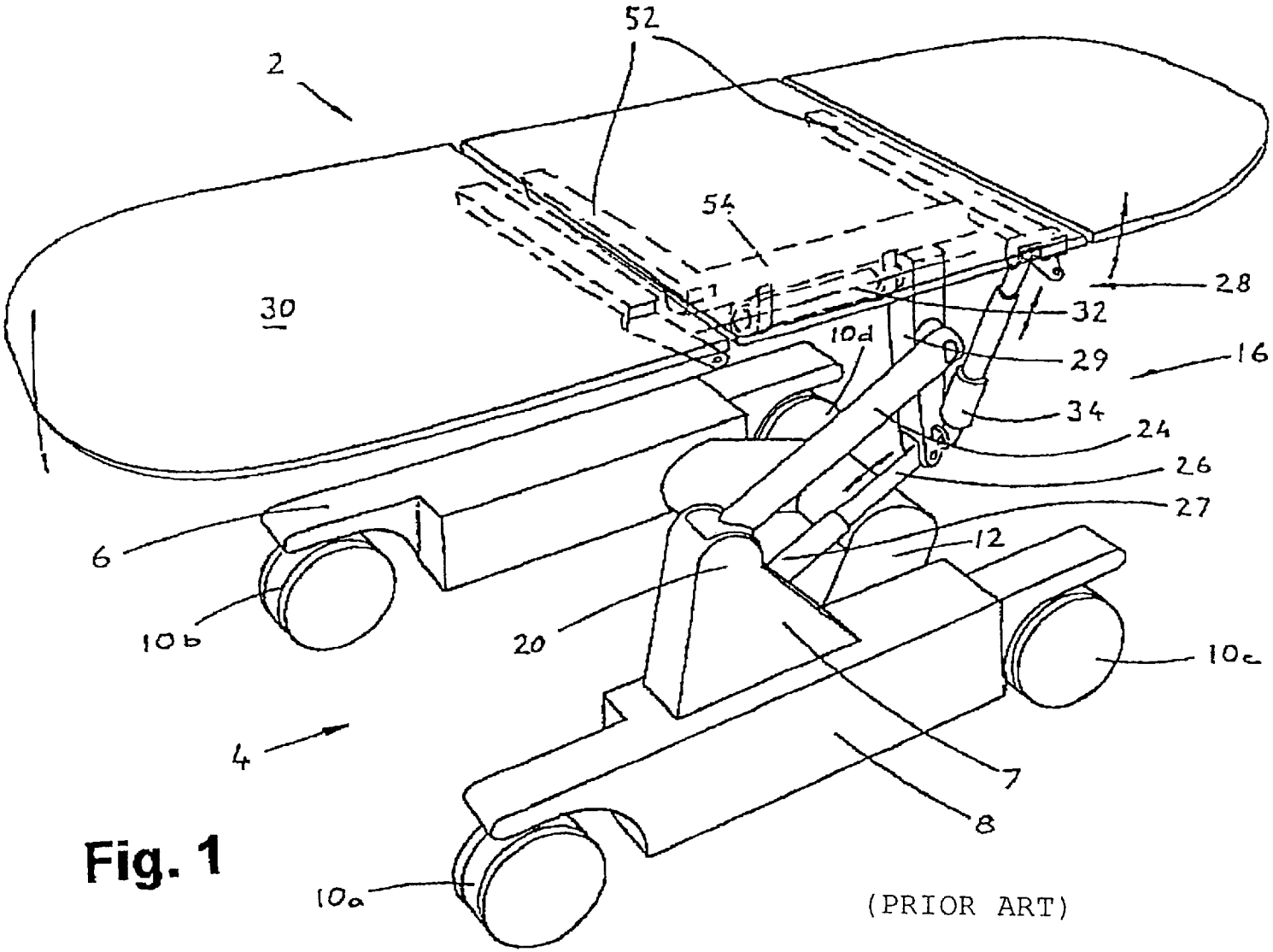
FIG. 1 is a perspective view of a roll bunk disclosed in U.S. Pat. No. 6,131,215.

A tiltable bunk device according to U.S. Pat. No. 6,131,215 is illustrated in FIG. 1, and designated generally with the reference numeral 2.

It comprises a frame 4 comprising two elongated box structures 6, 8 provided with a swivel castor 10*a–d* in each end thereof. The boxes 6, 8 are connected to each other via an essentially U-shaped element 12 made of metal tube. Said element 12 houses electrical cabling far energizing the various actuators. The width of the frame is sufficient to insure that it will render the entire device stable enough not to turn over. One box 6 contains batteries and relays. The other box 8 contains a linear actuator 14 (FIG. 5), used for the lifting mechanism of the bunk. The frame 4 has four wheels 10*a–d* on respective arms, where pairs of the arms extend laterally from opposite sides of a longitudinal center line of the roll coach and underneath a hospital bed when the roll coach is positioned directly adjacent to the hospital bed.

In general, the linear actuators used in the invention are based on a rotating screw, energized by an electrical motor. The screw runs in a nut that is secured in a pivotal member in such a way that the screw pulls or pushes said member when it rotates in the nut. However, it is of course conceivable to use other types of actuators, such as hydraulic cylinders to achieve the same function.

The bunk further comprises a lifting device, generally designated 16. Said lifting device comprises a linear actuator 14 connector a lever 18 (see FIGS. 5 and 6), a bearing 20, a bearing housing 22, a lifting arm 24, a parallel rod 26 comprising a linear actuator 27, and a lifting yoke 28. The box 8 has been removed from FIG. 6 in the interest of clarity.

Figure 5:
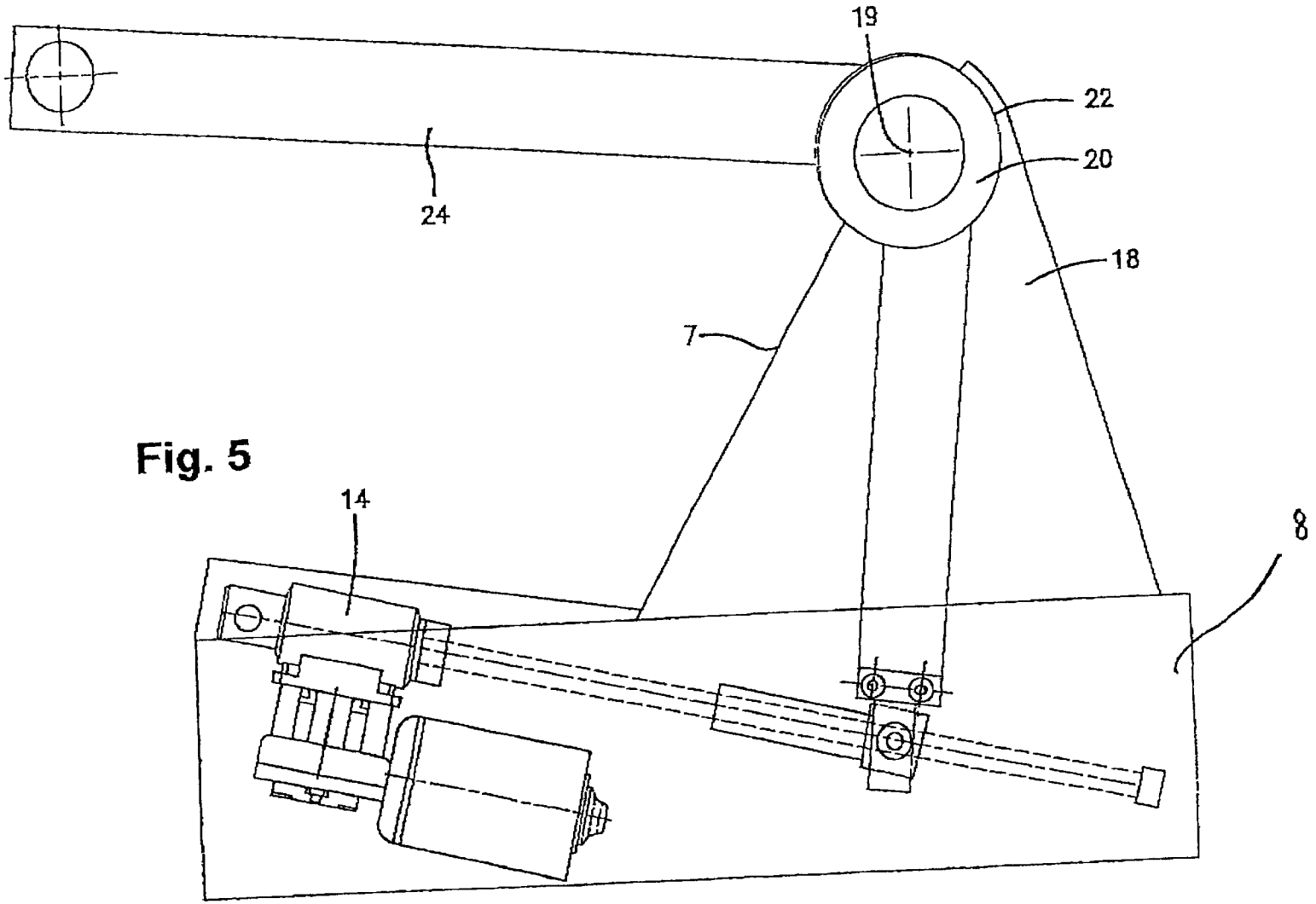
FIG. 5 is a view showing details of the lifting mechanism.
Figure 6:
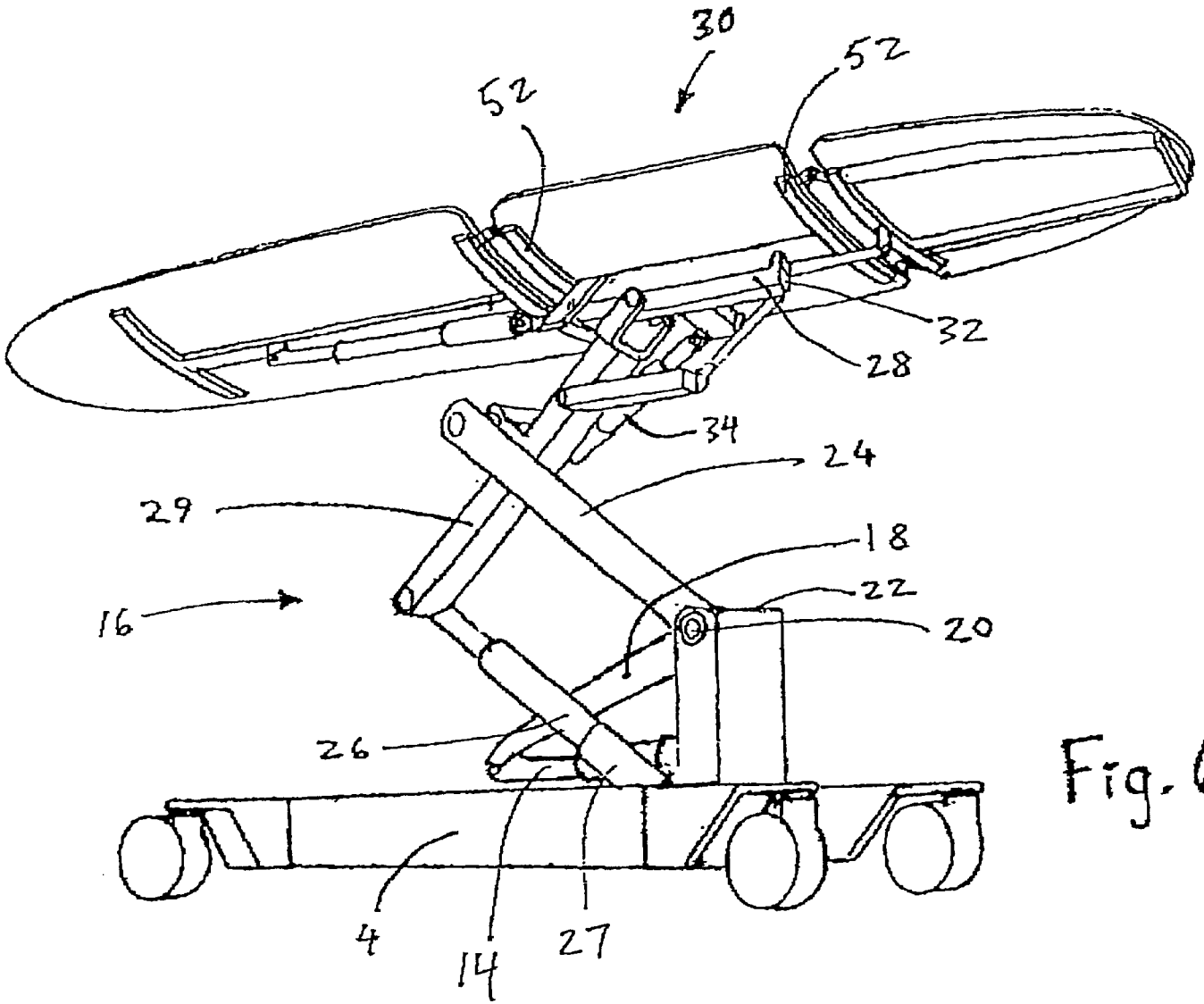
FIG. 6 is a further view of the lifting and tilting mechanisms.

On said box 8 there is a housing 7 containing i.a. said lever 18, The interior of said housing is shown in FIG. 5. The lever is pivotally connected in the same pivot point 19, i.e. the bearing 20, as the lifting arm 24. A linear actuator 14 is mounted in the box 8, and connected to the lever 18 in a pivot point in the end thereof opposite the end attached to said bearing 20, such that when the linear actuator 14 is energized, it will act on the lever 18 such that the lever will turn around the pivot point 19, thereby causing a movement of the lifting arm 24.

The yoke 28 comprises a vertical lifting element 29, in the shown embodiment made of a square profile tube. The lifting arm 24 and the parallel rod 26, respectively, are pivotally mounted on the vertical element 29, such that the lifting arm 24 is mounted approximately midway from the upper end of said element, and the parallel rod 26 is mounted at or near the lower end thereof.

The parallel rod 26 is further mounted in a pivot on said housing 7, such that when the linear actuator causes movement of the lifting arm 24, the parallel rod will restrict said vertical element 29 to take a vertical position during the raising and lowering movements.

The end of the lifting arm 24 is carried in a bearing in the lifting yoke 28, as is the parallel rod 26. The lever 18 and the lifting arm 24 form a unit such that when the lifting actuator 14 rotates/pivots the lever 18 in its bearing, also the lifting arm will be rotated/pivoted, thereby lifting the yoke 28 on which a bunk 30 is pivotally mounted. The parallel rod 26 is adapted to maintain/hold the yoke 28 and thereby also the bunk 30 at a constant angle with respect to the horizontal plane during the lifting movement. If the length of the parallel rod 26 is changed by energizing the motor of said linear actuator, the angle of the yoke 28 will change thereby changing the angle of the bunk in the longitudinal direction. In this way the bunk regardless of its elevation can assume different selectable inclinations, from a so called drainage position (low head end) to an upright position.

The yoke 28 has a horizontal axis 32, which is parallel to the bunk 30, and extends in the longitudinal direction of the bunk. On said axis 32 a horizontal rod 54 is pivotally mounted.

in the shown device, by means of a linear actuator 34, the bunk may be tilted sideways around the horizontal axis 32. One end of the actuator 34 is pivotally mounted in a portion of said yoke 28, the other end at the linear actuator 34 namely on one of said arms 52, that is located at the edge of the bunk on the side opposite the side which approaches the bed.

Figure 2:
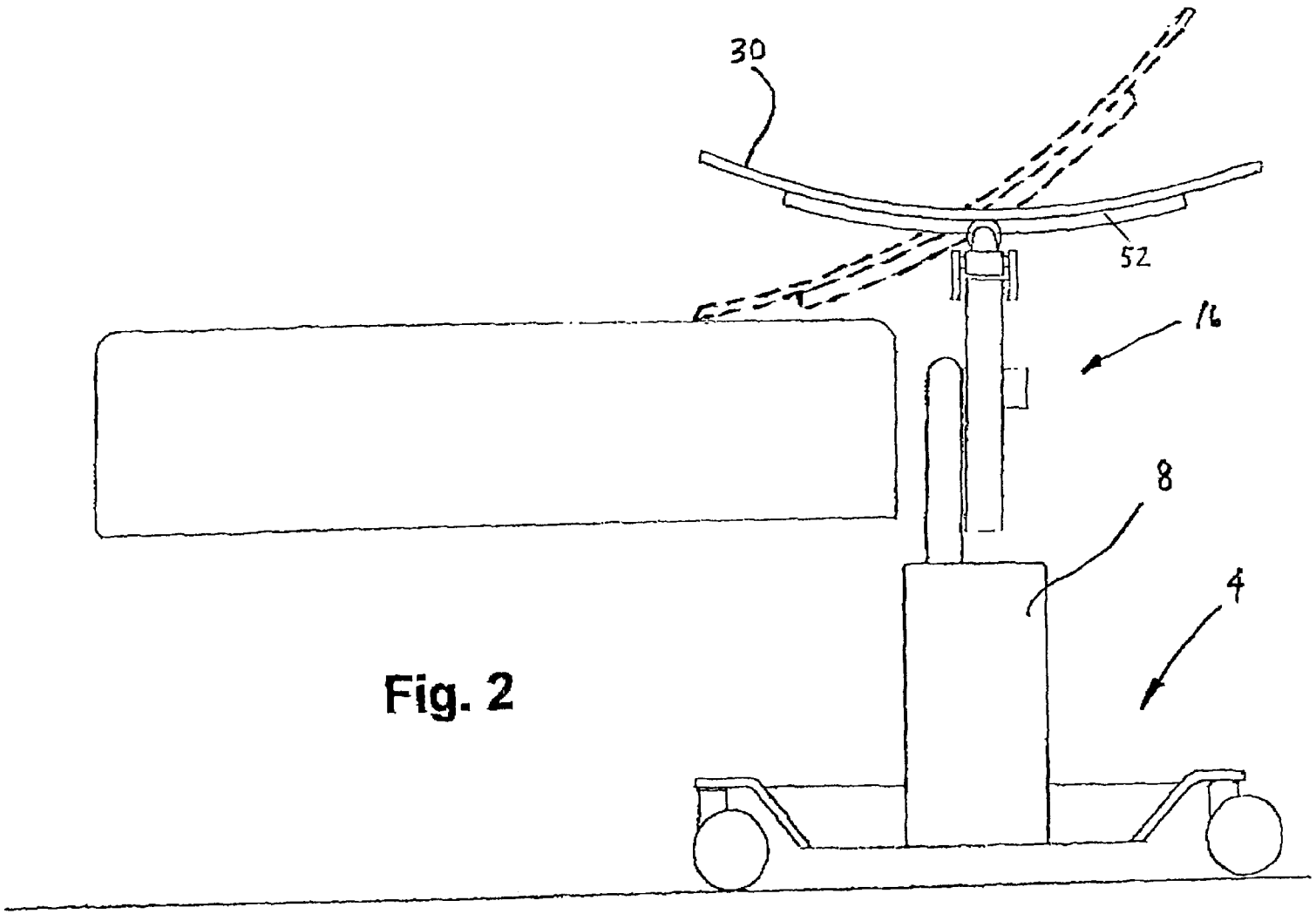
FIG. 2 is a view from behind of a bunk according to the present invention.
Figure 3:
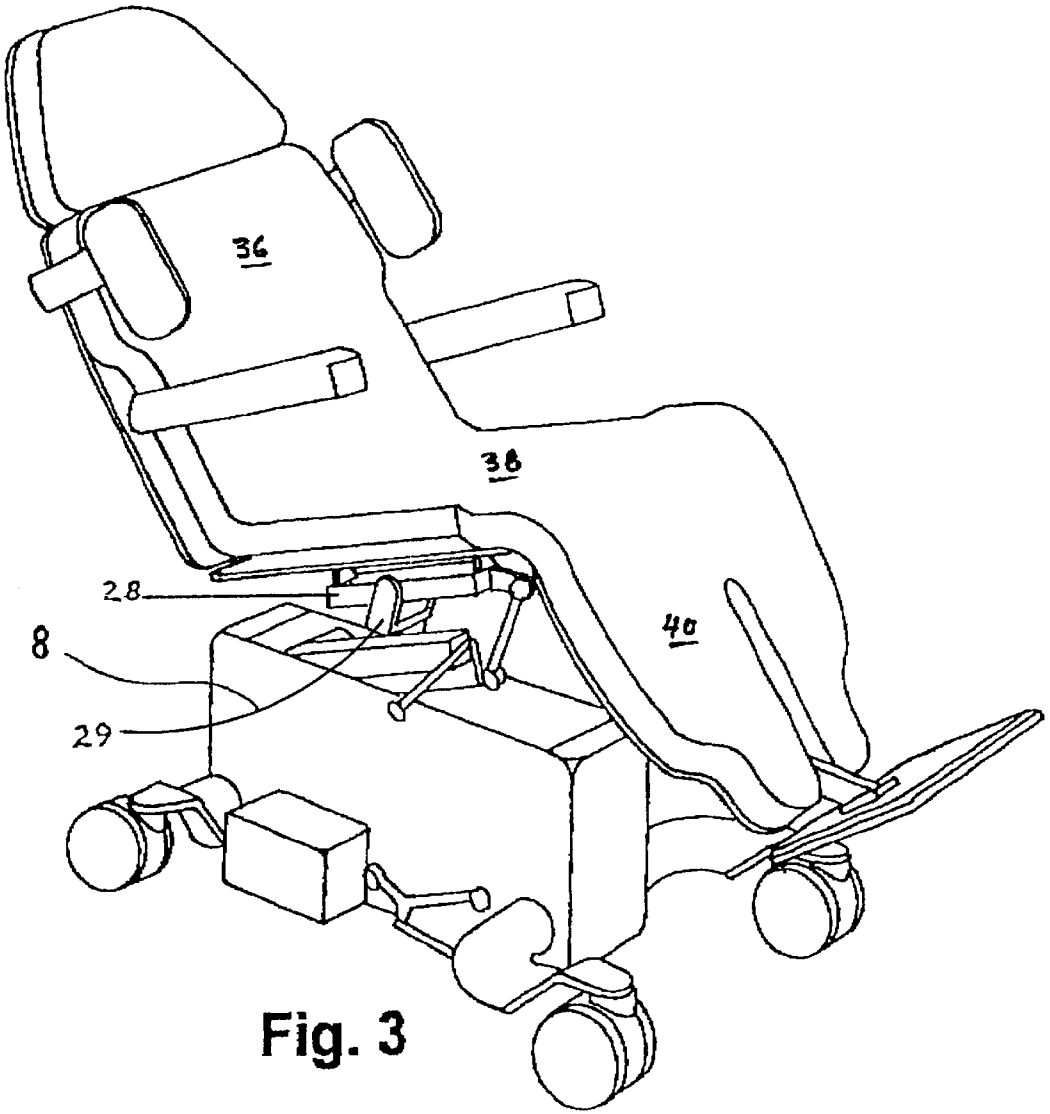
FIG. 3 is a perspective view showing the bunk in an upright sitting position.
Figure 4:
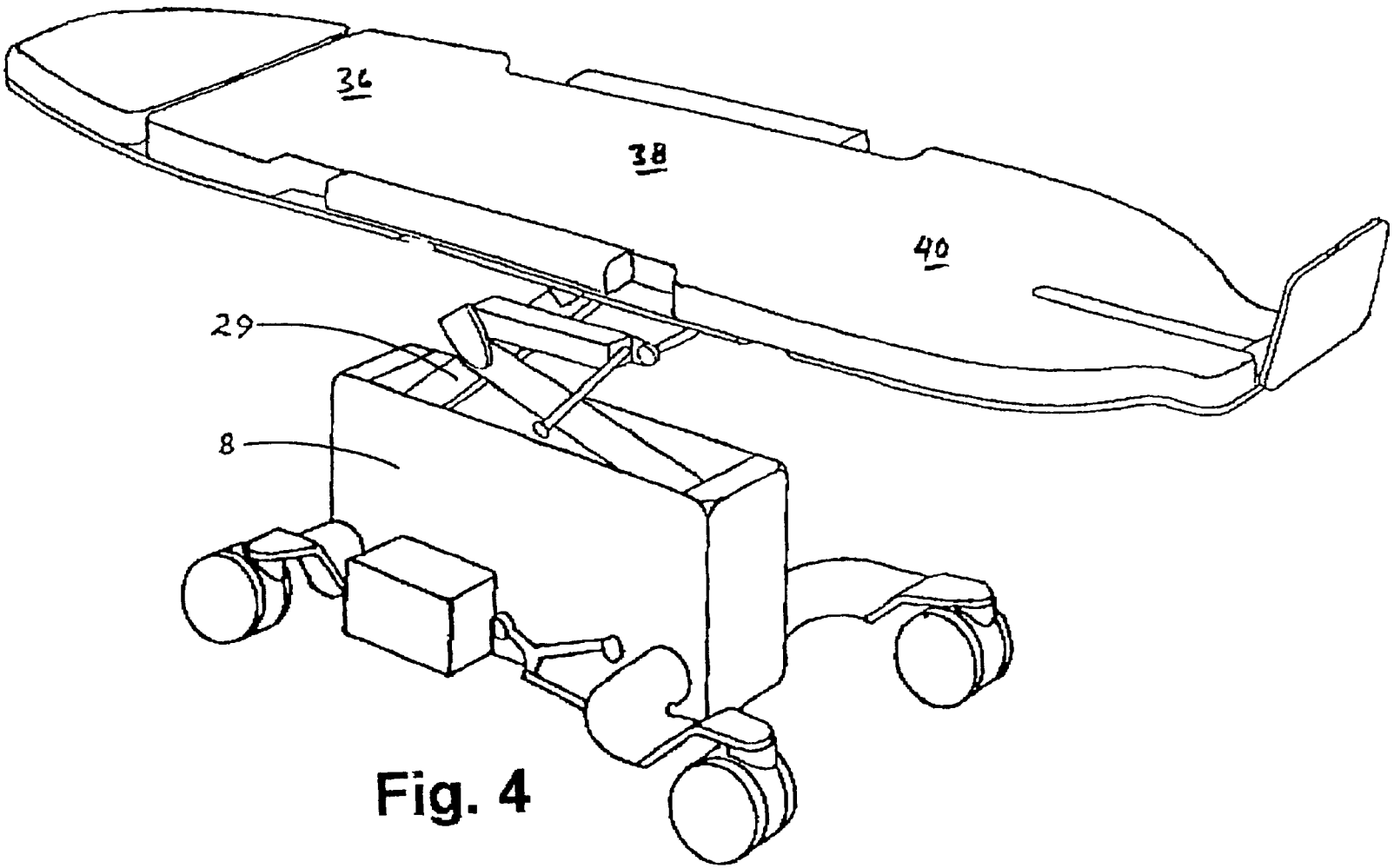
FIG. 4 is the same as FIG. 3 in a horizontal position.

In FIG. 2 a roll coach according to the present invention is shown in a view from behind (elements in FIGS. 2–6 that are common with elements in FIG. 1 have been given the same reference numerals). Thus, in order to facilitate access to beds in a hospital ward, where spaces between beds are narrow, on both sides of the bunk, the lifting mechanism has been mounted to the frame at a position on the longitudinal center line of the frame, In this way, the bunk 30 will extend equal distances outwards on both sides. Thus there is no need to turn the bunk 180° if for example one would wish to remove a patient from a bed adjacent another bed, onto which a patient just has been placed, using the coach. All elements of the roll coach disclosed in FIG. 1 are present in the roll coach shown in FIG. 2, except that the frame is constructed with one central box 8 that contains parts of the lifting mechanism so as to enable the attachment of the lifting mechanism as indicated.

The bunk 30 itself comprises three sections (See FIG. 3), namely back rest 36, seat 38 and leg rest 40. Back rest 36 and leg rest 40 are pivotally hinged to the seat 38 at opposite sides of the seat. The back rest 36 is connected to the leg rest 40 via a parallel rod. The parallel rod is pivotally mounted on back rest and foot rest respectively. To the back rest is also connected linear actuator, by means of which the angle of the back rest can be changed from a horizontal bed position (see FIG. 4) to an upright seated position (see FIG. 3). Thereby the leg rest 40 moves in parallel by virtue of the parallel rod connecting back rest 36 and leg rest 40.

The seat may comprise an opening covered with a removable lid for toilet purposes (not shown).

The parallel rod is connected to back rest 36 and foot rest 40 respectively via cantilever console members, mounted on the back rest 36 and leg rest 40 respectively. Said consoles are preferably mounted on the respective part, adjacent the edges where respective part pivotally connects to the seat 38.

The linear actuator is pivotally mounted in the console member belonging to the back rest 36, and its other end is mounted at a fixed point on the seat 38.

Use of the tiltable coach and the drag sheet according to a preferred embodiment of the invention will now be described by way of an exemplifying procedure according to the invention, wherein a patient is moved from the bed, therapy is carried out, and the patient is moved back onto the coach again.

EXAMPLE

In the process of moving a patient from a bed to the bunk of the invention, a drag sheet (disclosed in above referenced parent U.S. Pat. No. 6,131,215) is pulled out from under the mattress and wrapped around the patient, the long sides of the sheet being attached to each other by means of the VELCRO type fastening means. By pulling the straps on the drag sheet the patient is turned over so as to be lying on one side.

The bunk 30 is tilted (see FIG. 2, position indicated with broken line) to bring its side edge in contact with the bed surface, under the drag sheet, and the patient is conveniently pulled onto the bunk, which is then returned to a horizontal position.

One of the great advantages of the invention is the fact that one is able to place the patient on the bed by a sliding movement without needing to drag him or push him there using excessive force.

Previously one has always been forced to either push the patient onto the bed, which is difficult if it is a heavy patient, or one has had to bend over the bed for pulling. The bed being relatively wide, inevitably renders the working position very unsuitable from an ergonomic point of view, The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A roll coach for moving patients to and from a hospital bed, comprising:

a) a frame (4);

b) a movable bunk (30) mounted on said frame;

c) a lifting mechanism (16, 14, 18, 20, 22, 24, 26, 27, 28) connecting said bunk with said frame and operable to move said bunk in a vertical direction, said mechanism being connected to the frame along the longitudinal centerline thereof, said lifting mechanism comprising a linear actuator (14) provided in the frame and pivotally connected to a lever (18), pivotally mounted in a bearing (20), and a lifting arm (24) rigidly connected to said lever and movable together with said lever in said bearing, a vertical lifting member (29) to which said lifting arm is connected, such that when said linear actuator is displaced said lifting arm moves, thereby causing movement of said vertical lifting member; and (d) a tilting mechanism (28, 32, 54, 34, 52) operable to tilt said bunk to bring the side of said bunk in contact with the bed.

2. The roll coach of claim 1, wherein said frame is adapted to be insertable under a hospital bed, whereby said bunk is moveable sideways over said bed.

3. The roll coach of claim 1, wherein said tilting mechanism comprises a yoke (28) on which said bunk rests, having two supporting arms (52) attached to a longitudinal rod member (54), pivotally mounted on said lifting member.

4. The roll coach of claim 1, wherein said bunk comprises three portions, a back rest (36), a seat (38), and a leg rest (40), said back rest and leg rest being pivotally connected to the seat, and connected with each other by parallel linkage means such that they are movable in ensemble to an upright position.

5. The roll coach of claim 1, wherein said bunk is tiltable in the longitudinal direction while kept in a plane position, such that the patient will retain his stretched out position during tilting.

6. The roll coach of claim 1, wherein said bunk is tiltable in the longitudinal direction while kept in a sitting mode, such that the patient will retain his sitting position during tilting.

7. The roll coach of claim 1, comprising means for reversing movements caused by said lifting mechanism and said tilting mechanism.

8. A roll coach for moving a patient to and from a hospital bed, the roll coach comprising:

a frame (4);

a movable bunk (30) mounted on said frame, both lateral sides of said frame being insertable under a hospital bed so that said bunk is moveable sideways over opposite sides of the hospital bed;

a lifting mechanism (16) connecting said bunk with said frame and operable to move said bunk in a vertical direction, said mechanism being connected to the frame along a longitudinal centerline thereof, said bunk extending equal distances outwards on both sides of said frame;

a tilting mechanism (34) operable to tilt said bunk to bring the side of said bunk in contact with the bed.

9. The roll coach of claim 8, wherein said lifting mechanism comprises a linear actuator (14) provided in the frame and pivotally connected to a lever (18), pivotally mounted in a bearing (20), and a lifting arm (24) rigidly connected to said lever and moveable together with said lever in said bearing, a vertical lifting member (29) to which said lifting arm is connected, such that when said linear actuator is displaced said lifting arm moves, thereby causing movement of said vertical lifting member.

10. The roll coach of claim 8, wherein said tilting mechanism comprises a yoke (28) on which said bunk rests, having two supporting arms (52) attached to a longitudinal rod member (54), pivotally mounted on said lifting member.

11.The roll coach of claim 8, wherein said bunk comprises three portions, a back rest (36), a seat (38), and a leg rest (40), said back rest and leg rest being pivotally connected to the seat, and connected with each other by parallel linkage means such that they are movable in ensemble to an upright position.

12. The roll coach of claim 8, wherein said bunk is tiltable in a longitudinal direction.

13. The roll coach of claim 12, wherein said bunk is tiltable in the longitudinal direction while kept in a sitting mode, such that a patient on said bunk will retain a sitting position during tilting.

14. The roll coach of claim 8, comprising means for reversing movements caused by said lifting mechanism and said tilting mechanism.

15. The roll coach of claim 8, wherein said lifting mechanism comprises a linear actuator (14) that is connected to a vertical lifting member (29) through a lifting arm (24) and a parallel rod (26), and wherein said linear actuator operates to change a length of said parallel rod to change a longitudinal angle of said bunk.

16. A roll coach for a moving a patient to and from a hospital bed, the roll coach comprising:

a movable frame (4) with four wheels (10) on respective arms, pairs of said arms extending laterally from opposite sides of a longitudinal centerline of the roll coach and underneath a hospital bed when the roll coach is positioned directly adjacent to the hospital bed;

a movable bunk (30) having longitudinal front, center, and back portions, a first lateral side of said bunk extending over the hospital bed when the roll coach is positioned directly adjacent to one side of the hospital bed and a second lateral side of said bunk that is opposite the first side extending over the hospital bed when the roll coach is positioned directly adjacent to another side of the hospital bed that is opposite the one side;

a lifting mechanism (16) connecting said bunk to said frame for changing an elevation of said bunk relative to said frame, said lifting mechanism extending from a longitudinal center part of said frame along a longitudinal centerline of said frame and attaching to said bunk at said center portion of said bunk along a longitudinal centerline of said bunk, said lifting mechanism comprising a longitudinally extended linear actuator (14) in said frame that is connected to a vertical lifting member (29) that is connected to said bunk; and a tilting mechanism (34) connected to said bunk that tilts said bunk laterally, said tilting mechanism being connected to said bunk at said center portion along a longitudinal centerline of said bunk.

17. The roll coach of claim 16, wherein said lifting mechanism further comprises a lifting arm (24) and a parallel rod (26) that connect said linear actuator to said vertical lifting member, and wherein said linear actuator operates to change a length of said parallel rod to change a longitudinal angle of said bunk.

* * * * *